US006752703B2

(12) United States Patent
Boyd et al.

(10) Patent No.: US 6,752,703 B2
(45) Date of Patent: Jun. 22, 2004

(54) CHEMICAL MECHANICAL POLISHING APPARATUS AND METHODS WITH POROUS VACUUM CHUCK AND PERFORATED CARRIER FILM

(75) Inventors: John M. Boyd, Atascadero, CA (US); Miguel A. Saldana, Fremont, CA (US); Damon Vincent Williams, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 201 days.

(21) Appl. No.: 10/029,515

(22) Filed: Dec. 21, 2001

(65) Prior Publication Data

US 2003/0119431 A1 Jun. 26, 2003

(51) Int. Cl.[7] ..... B24B 7/22
(52) U.S. Cl. ..... 451/289; 451/388
(58) Field of Search ..... 451/289, 288, 451/287, 388, 398, 41

(56) References Cited

U.S. PATENT DOCUMENTS 5,645,474 A * 7/1997 Kubo et al. ..... 451/289
5,964,646 A * 10/1999 Kassir et al. ..... 451/41
6,139,409 A * 10/2000 Inaba ..... 451/288
6,257,966 B1 * 7/2001 Ishikawa et al. ..... 451/67
6,422,922 B1 * 7/2002 Okamura et al. ..... 451/41

* cited by examiner

*Primary Examiner*—Robert A. Rose
(74) *Attorney, Agent, or Firm*—Martine & Penilla, LLP

(57) ABSTRACT

CMP systems and methods provide necessary vacuum and pressure to be applied from a vacuum chuck through a carrier film to a wafer without interfering with desired wafer planarization during CMP operations. Prior low polish rate-areas on the wafer may be eliminated from an exposed surface of the wafer by structure to uniformly compress the carrier film in response to a force from the wafer on the carrier film during the CMP operations. A distance between, and diameters of, adjacent holes of the carrier film are reduced, and the locations of the holes are in an array to coordinate with passageways through the vacuum chuck. The structure significantly reduces a maximum value of compression of the carrier film during CMP operations. As a result, during the CMP operations the wafer does not deform in a manner that exactly matches the compression of the carrier film, but remains essentially flat.

8 Claims, 11 Drawing Sheets

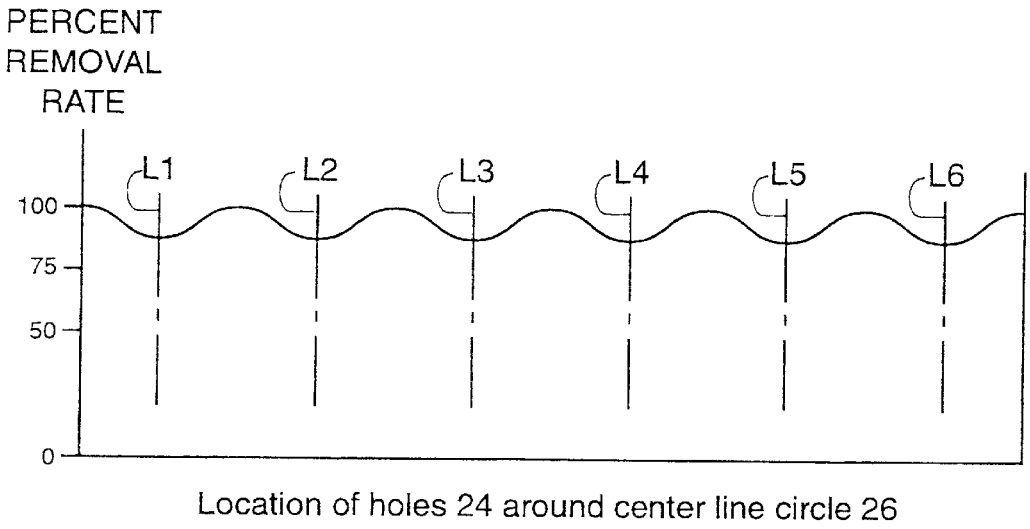
Fig. 1C
(Prior Art)
Fig. 1D
(Prior Art)
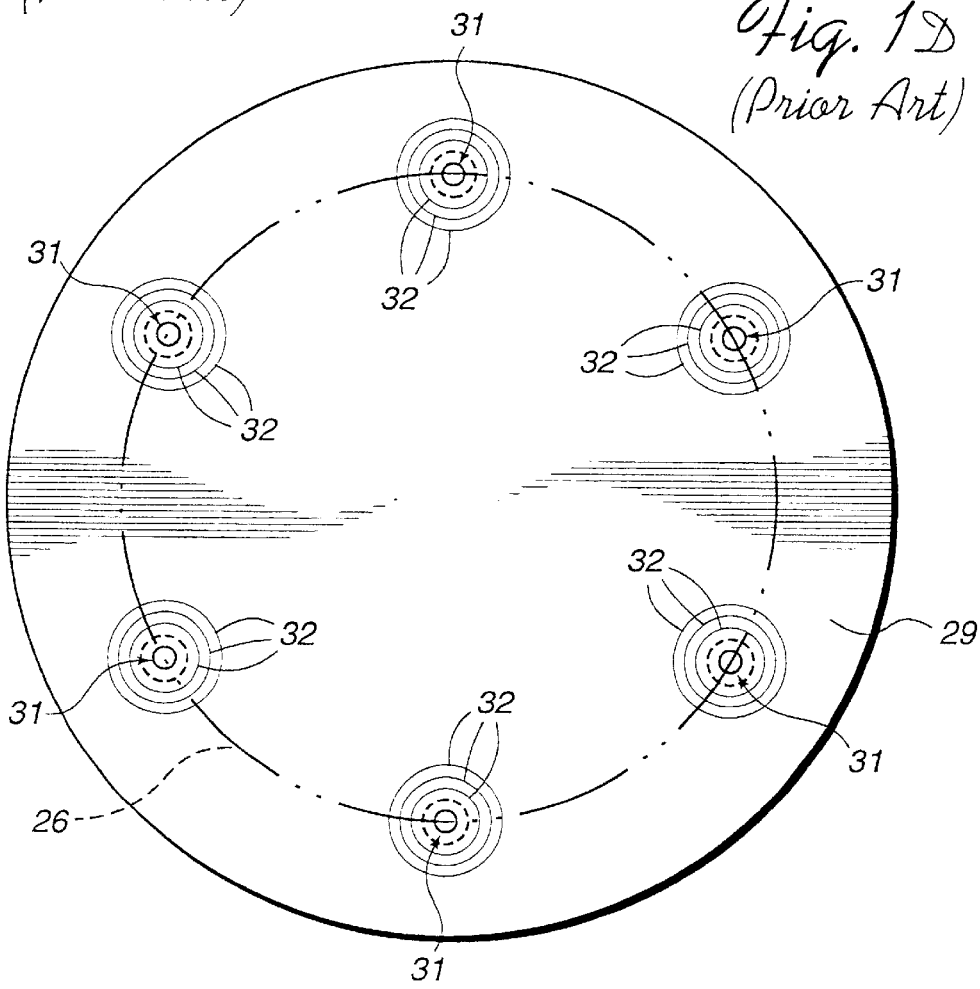

(analysis)

(analysis)

Fig. 2B
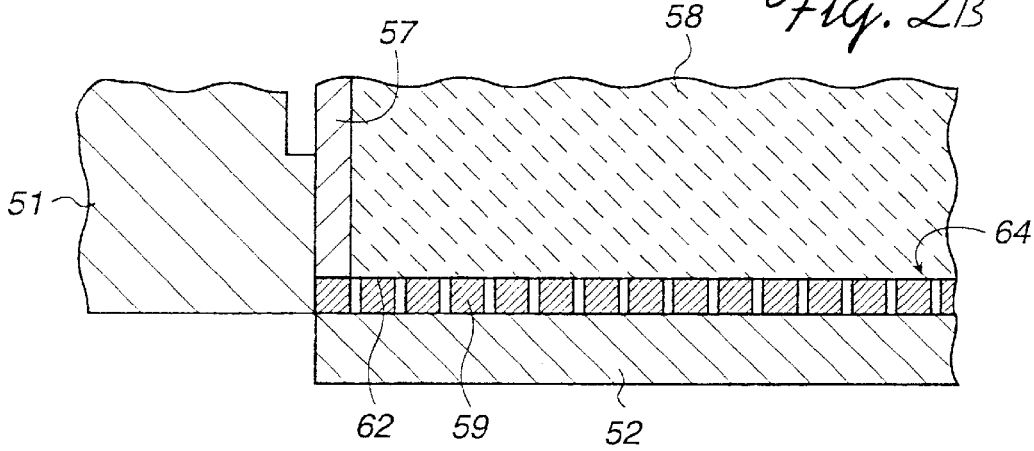
Fig. 3A
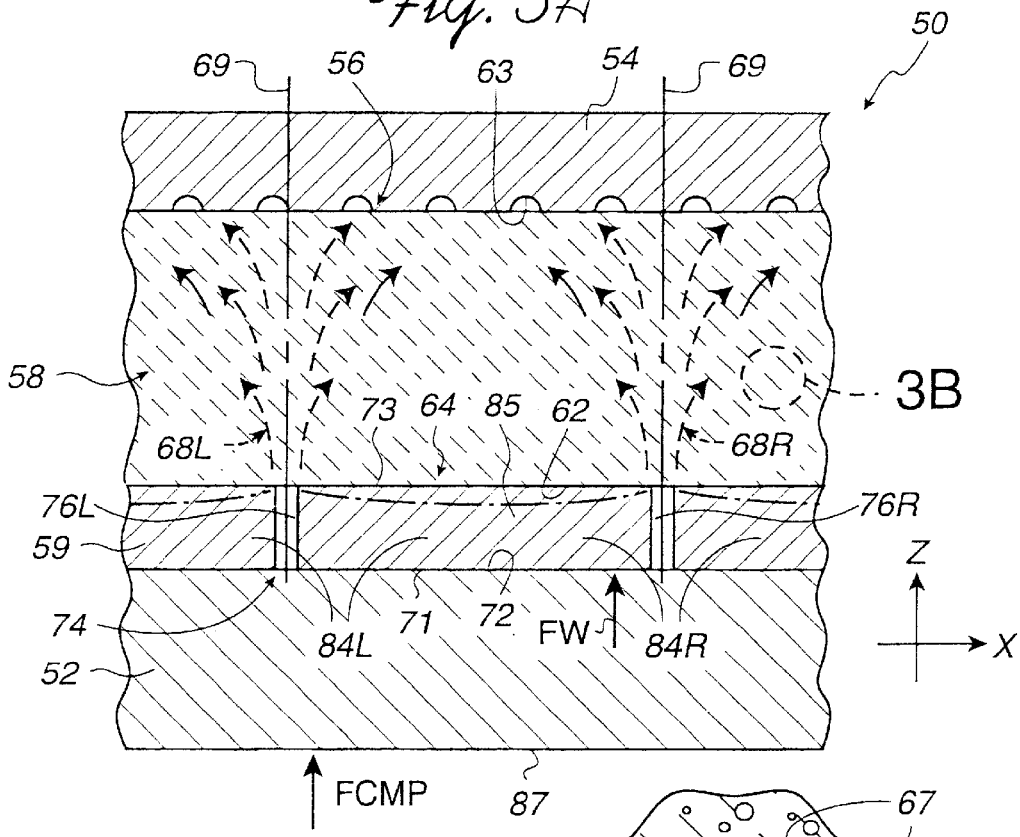
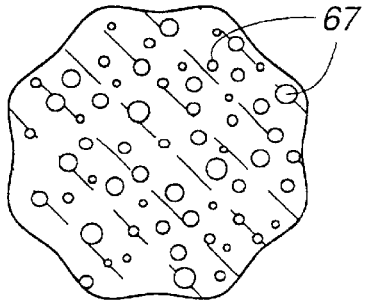
Fig. 3B

CHEMICAL MECHANICAL POLISHING APPARATUS AND METHODS WITH POROUS VACUUM CHUCK AND PERFORATED CARRIER FILM

CROSS REFERENCE TO RELATED APPLICATION

The present application is related to a co-pending U.S. Patent Application filed on the same date as the present application by Yehiel Gotkis, David Wei, Aleksander Owzarz, and Damon V. Williams and entitled "Wafer Carrier and Method for Providing Localized Planarization of a Wafer During Chemical Mechanical Planarization"and such related application is hereby incorporated by reference.

BACKGROUND OF THE INVENTION

1. Field of the Invention

The present invention relates generally to chemical mechanical polishing (CMP) systems, and to techniques for improving the performance and effectiveness of CMP operations. More specifically, the present invention relates to apparatus and methods for consistently releasably securing a wafer to and releasing the wafer from a CMP carrier, while reducing interference by such apparatus and methods with CMP operations performed on the wafer.

2. Description of the Related Art

In the fabrication of semiconductor devices, there is a need to perform CMP operations, including polishing, buffing and wafer cleaning; and to perform wafer handling operations in conjunction with such CMP operations. For example, a typical semiconductor wafer may be made from silicon and, for example, may be a disk that is 200 mm or 300 mm in diameter. The 200 mm wafer may have a thickness of 0.028 inches, for example. For ease of description, the term "wafer" is used below to describe and include such semiconductor wafers and other planar structures, or substrates, that are used to support electrical or electronic circuits.

Typically, integrated circuit devices are in the form of multi-level structures fabricated on such wafers. At the wafer level, transistor devices having diffusion regions are formed. In subsequent levels, interconnect metallization lines are patterned and electrically connected to the transistor devices to define the desired functional device. Patterned conductive layers are insulated from other conductive layers by dielectric materials. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

In a typical CMP system, a wafer is mounted on a carrier with a surface of the wafer exposed for CMP processing. The carrier and the wafer rotate in a direction of rotation. The CMP process may be achieved, for example, when the exposed surface of the rotating wafer and an exposed surface of a polishing pad are urged toward each other by a force, and when such exposed surfaces move in respective polishing directions. For wafer handling after completion of one step of the CMP processing, a vacuum may be applied to the carrier to retain the wafer on the carrier as the carrier and the wafer are moved to a next CMP processing station. Upon completion of the CMP processing using that carrier, pressure may be applied to the carrier in a "blow off" operation to force the wafer from the carrier.

A situation has been encountered in providing apparatus and methods for retaining the wafer on the carrier during such carrier/wafer movement, and in providing the blow off pressure to the carrier to force the wafer from the carrier. This situation is described with reference to FIG. 1A, which shows a plan view looking upwardly to a typical prior carrier 20. The carrier 20 is a disk-like structure having a diameter in excess of seven inches and a flat surface 21 that provides support for a protective carrier film 22 which supports a wafer 23 during the CMP processing. In FIG. 1A, the wafer 23 is shown cut away to expose the film 22, and the film 22 is shown cut away to expose the carrier 20. An exemplary six to twenty holes are typically formed through the carrier 20. In FIG. 1A, six holes 24 are illustrated, each about 0.040 inches in diameter and typically formed through the prior carrier 20 at locations L1 through L6 across the flat surface 21 as shown in cross section in FIG. 1B. As described below, locations L1 through L6 are widely spaced.

In one embodiment of the prior carrier 20, each of the holes 24 is centered on a circular line 26 having a diameter of between six and seven inches. The circular line 26 is coaxial with a center 27 of the prior carrier 20. Around the circular line 26, uniform spacing of each one of the six holes 24 from all other of the holes may be about three and one-half inches, which is defined as "widely spaced" and across the diameter of the circular line 26 the hole-to-hole spacing may exceed six inches, which is within the definition of "widely spaced". In such embodiment, the flat surface 21 of the prior carrier 20 is typically protected using a consumable layer in the form of the carrier film 22 having a thickness of about 0.020 inches and a diameter corresponding to the diameter of the prior carrier 20. The carrier film 22 overlies the flat surface 21. The carrier film 22 is provided with six punched holes 28 each having a diameter of about 0.060 inches. The carrier film holes 28 are centered on a similar circle having a diameter of between six and seven inches. Each carrier film hole 28 is coaxial (i.e., aligned) with the center of a corresponding one the six carrier film holes 24.

With such background in mind, the situation that has been encountered relates to the following. Although the exemplary six carrier holes 24 and the exemplary six aligned carrier film holes 28 generally provide enough vacuum to the wafer 23 for retaining the wafer 23 on the prior carrier 20 during such carrier/wafer movement, and for applying the blow off pressure to the wafer 23 on the prior carrier 20, when such prior carrier 20 and carrier film 22 are used with the wafer 23 in CMP operations, undesired deformation of the wafer 23 occurs. For example, FIGS. 1C and D depict results of examining a surface 29 of the wafer 23 that was exposed to a CMP polishing pad 36 (FIG. 1B) during a CMP operation using the prior carrier 20 and carrier film 22 described above. FIG. 1C graphically shows percent removal rate plotted against the locations L1 through L6 at which the carrier holes 24 and the carrier film holes 28 are spaced around the circle 26. The removal rate is the rate at which CMP occurs on the exposed surface 29, and may be measured in Angstrom units, for example. Although a 100% polishing removal rate is desired on the entire area of the exposed wafer surface 29, FIG. 1C shows that there is a decrease (or reduction) of up to 15% in the percent removal rate. FIG. 1D shows that such decrease corresponds to low removal rate portions 31 of the exposed area 29 (centered at the aligned holes 24 and 28 at locations L1 through L6 on the wafer 23). The portions 31 of the exposed surface 29 of the wafer 23 corresponding to the decreased polishing removal rate may also be referred to as "low polish-rate areas"and are depicted in FIG. 1D by many circular lines 32 centered at the centers of the respective coaxial holes 24 and 28. The outer circular lines 33 are shown having diameter exceeding that of both of the respective holes 24 and 28 to illustrate that the low polish rate areas extend radially from such centers to distances greater than the diameter of the largest (i.e., the carrier film) hole 28. Thus, there is an effect, termed a "field effect", of reduced percent removal rate having a diameter significantly exceeding the diameter of the larger (carrier film) holes 28. The low polish-rate areas, or portions, 31 of the exposed surface 29 of the wafer 23 may have a diameter of up to about one inch, for example. These low polish-rate areas may be unusable for fabricating silicon devices, add to manufacturing costs due to a need to locate such portions, and reduce the yield of the polished wafers.

This situation relating to the low polish rate areas 31 is complicated by the ongoing need to provide a way for vacuum and pressure to be applied from the prior carrier 20 through the carrier film 22 to the wafer 23 for the above-noted necessary wafer handling operations. Since these wafer handling operations are necessary, in the past it has not been acceptable to use a carrier 20 without such six to twenty holes 24. However, a problem is that the cause of the low percent removal rate portions 31 has not been apparent. Thus, currently, although the low percent removal rate portions 31 are produced on the wafer 23, such prior carriers 20 and prior carrier films 22, each having the respective six to twenty aligned holes 24 and 28, are still in commercial use.

What is needed then, is an identification of the cause of the low polish rate areas 31, coupled with a solution, such that a CMP system would be provided in which apparatus and methods furnish both the necessary vacuum and pressure from the carrier through the carrier film to the wafer without interfering with the desired planarization of the wafer during CMP operations. Moreover, since the desired CMP operations must apply the CMP force against the exposed surface of the wafer to polish that exposed surface, what is needed is an identification of such cause, and a solution defining a way to apply such CMP force without having portions of the wafer experience reduced removal rates

SUMMARY OF THE INVENTION

Broadly speaking, the present invention fills these needs by identifying the cause of the low polish-rate areas, and by providing CMP systems and methods which implement solutions to the above-described problems. Thus, by the present invention, both the necessary vacuum and pressure may be applied from a vacuum chuck of the carrier through a carrier film to the wafer without interfering with the desired planarization of the wafer during CNP operations. The present invention identifies, as the cause of the low polish rate-areas on the wafer, non-uniform compression of the carrier film in response to a force from the wafer on the carrier film during the CMP operations. The present invention eliminates the cause of the low removal rate portions by CMP apparatus and methods that uniformly compress the carrier film in response to a force from the wafer on the carrier film during the CMP operations.

In the present invention, one aspect of achieving the uniform carrier film compression is significantly reducing the distance between adjacent holes of the carrier film. Another aspect of the present invention involves coordinating the locations of such holes and reducing the diameter of the holes in the carrier film. In this manner, the compression of the carrier film is significantly more uniform as evidenced by elimination of the low removal rate portions 31.

In another aspect of the present invention, the configurations of the carrier film and of the vacuum chuck structures are coordinated to provide such solutions. The vacuum chuck has opposite first and second surfaces. The first surface defines a first mounting area. The vacuum chuck has a rigid porous structure extending between the first and second surfaces adjacent to substantially all of the first mounting area. The carrier film has a third surface configured to engage a wafer, and has a fourth surface configured to engage the first surface of the vacuum chuck. The carrier film has an array of holes extending across substantially all of the fourth surface. Each of the holes extends from the third surface to the fourth surface. Such structural coordination is that each of the holes overlaps the rigid porous structure of the ceramic material upon engagement of the fourth surface of the carrier film with the first surface of the vacuum chuck.

In yet another aspect of the invention, the coordination of the configurations of structures of the wafer carrier film and of the vacuum chuck is provided to reduce the effects of the structures on chemical mechanical polishing operations performed on the wafer mounted on the structures. The carrier film has a first surface configured to engage the wafer and a second surface configured with a pressure transfer area. The carrier film has a uniform two-dimensional arrangement of holes extending completely across the vacuum transfer area. Each of the holes extends along a third dimension between the first and second surfaces. Each of the holes of the uniform two-dimensional arrangement of holes is aligned with at least one passage through the vacuum chuck by structure of the vacuum chuck that is in engagement with the pressure transfer area. The vacuum chuck structure is rigid and porous, defined by sintered ceramic material having micropores.

In a related aspect of the present invention, each hole in the uniform two-dimensional arrangement of holes in the carrier film has a diameter of from about 0.005 +or −0.002 inches to about 0.020 +or −0.002 inches and the array spaces one hole from many adjacent holes by a distance of about 0.060 to 0.250 inches.

In still another aspect of the invention, a method of manufacturing a wafer carrier film and a vacuum chuck is provided for reducing the effects of the film and the chuck on chemical mechanical polishing operations performed on the wafer mounted on the film. Operations of the method may include providing the vacuum chuck having opposite first and second surfaces. The first surface defines a first mounting area, and the vacuum chuck has a rigid porous structure extending between the first and second surfaces adjacent to substantially all of the first mounting area. In another operation, there is provided a carrier film having a third surface configured to engage the wafer and a fourth surface configured to engage the first surface of the vacuum chuck. The carrier film is provided with an array of holes extending across substantially all of the fourth surface. Another operation engages the first mounting area with the fourth surface of the carrier film to cause each of the holes of the array to overlap the rigid porous structure of the ceramic material.

A further aspect of the present invention relates to the operation of providing the carrier film, which provides the array of holes in a uniform geometric pattern. The uniform geometric pattern may be defined by equilateral triangles, or may be defined by a grid of orthogonally arranged lines, wherein the locations of the holes are defined by intersections of the lines.

Yet another aspect of the present invention relates to apparatus for positioning a wafer for chemical mechanical polishing operations. A housing has a manifold for distributing gas at a range of pressures from a vacuum to positive pressure. A vacuum chuck is mounted on the housing overlying the manifold for receiving the range of pressures. The vacuum chuck has a structure configured with a flat mounting section having a mounting area and comprising micropores extending across substantially all of the mounting area. Groups of the micropores provide continuous passageways extending generally perpendicular to the flat mounting section. A carrier film is mounted on the vacuum chuck and has a first surface configured to engage a wafer and a second surface configured to engage substantially all of the mounting area. The carrier film may have about 100 holes per square inch of the second surface. The holes extend from the first surface to the second surface in a two-dimensional uniform pattern extending across the entire second surface. Each of the holes may be overlapped by at least one group of the micropores of the ceramic material when the mounting area of the vacuum chuck engages the second surface of the carrier film. The overlapped relationship aligns each hole of the carrier film with the continuous passageway defined by the at least one group of micropores. With the passageways of the vacuum chuck aligned with the holes of the carrier film, and with the exemplary about 100 holes per square inch of the second surface of the carrier film providing the holes located at aligned locations that are very close together, the effect of the CMP force pressing the CMP polishing pad and the wafer against each other is significantly different from that of the prior art described above, and does not interfere with the desired planarization of the wafer during CMP operations.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, wherein like reference numerals designate like structural elements.

FIGS. 2A and 2B are cross sectional views schematically showing a carrier of the present invention in the form of a porous chuck having a rigid porous structure defined by micropores in sintered ceramic material;

FIGS. 3A and 3B depict an enlarged portion of FIG. 2A, schematically showing the carrier of FIG. 2A having a carrier film thereon, wherein the carrier film is provided with an array of holes, illustrating one group of the micropores aligned with one of the holes of the array in the carrier film;

DETAILED DESCRIPTION OF THE PREFERRED EMBODIMENTS

An invention is described for a CMP system, and methods, in which the problem of the prior situation is identified and solutions to such problem are provided. Structures and operations provide both the necessary vacuum and pressure that may be applied from a vacuum chuck of the carrier through a carrier film to the wafer without interfering with the desired planarization of the wafer during CMP operations. Such solutions consider that desired CMP operations apply a force to the wafer and through the wafer to the carrier film and to the vacuum chuck. Such identification of the problem is coupled with solutions that allow the carrier film to more uniformly compress in response to the force from the wafer. In this manner, when the normally-flat surface of the wafer tends to assume the shape of the carrier film during CMP operations, the surface of the wafer that contacts the polishing pad, for example, will remain substantially flat.

In providing such solutions, configurations of the carrier film and the vacuum chuck structures are coordinated. The coordination may involve the distance between adjacent holes of the carrier film, and the diameter of those holes, both of which are substantially reduced. With the reduced diameters and distance, the locations of these holes are coordinated with the structure of the vacuum chuck by providing the chuck with a porous structure. In this manner, the compression of the carrier film is significantly more uniform as evidenced by elimination of the low polish-rate areas.

In the following description, numerous specific details are set forth in order to provide a thorough understanding of the present invention. It will be understood, however, to one skilled in the art, that the present invention may be practiced without some or all of these details. In other instances, well known process operations and structure have not been described in detail in order not to obscure the present invention.

Figure 1A:
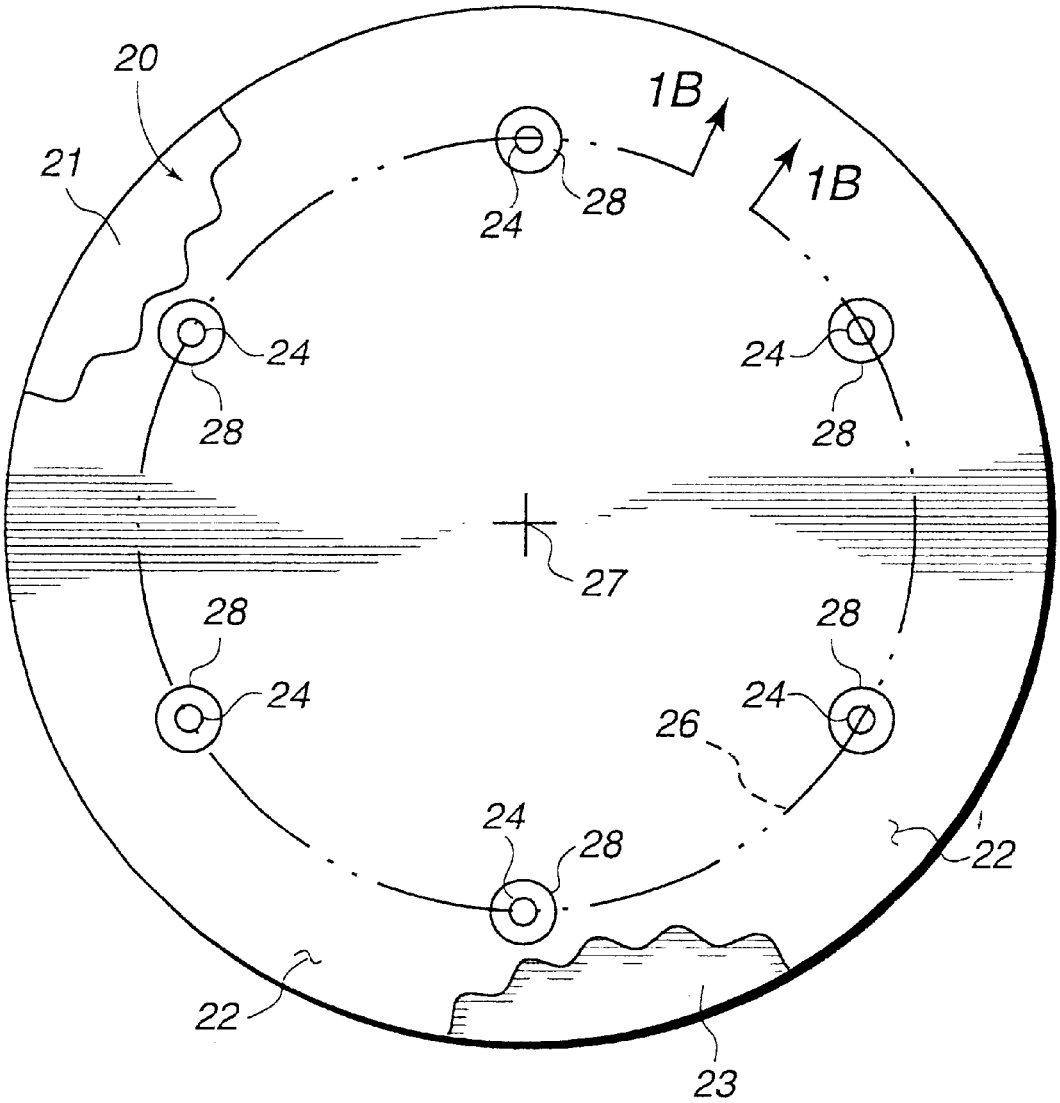
Fig. 1A (Prior Art)
FIG. 1A is a view looking up at a bottom of a typical prior carrier, with a wafer and a carrier film shown cut away to reveal the carrier as a disk-like structure having six carrier holes, each about 0.040 inches in diameter, formed at widely spaced locations across a flat surface.
Figure 1B:
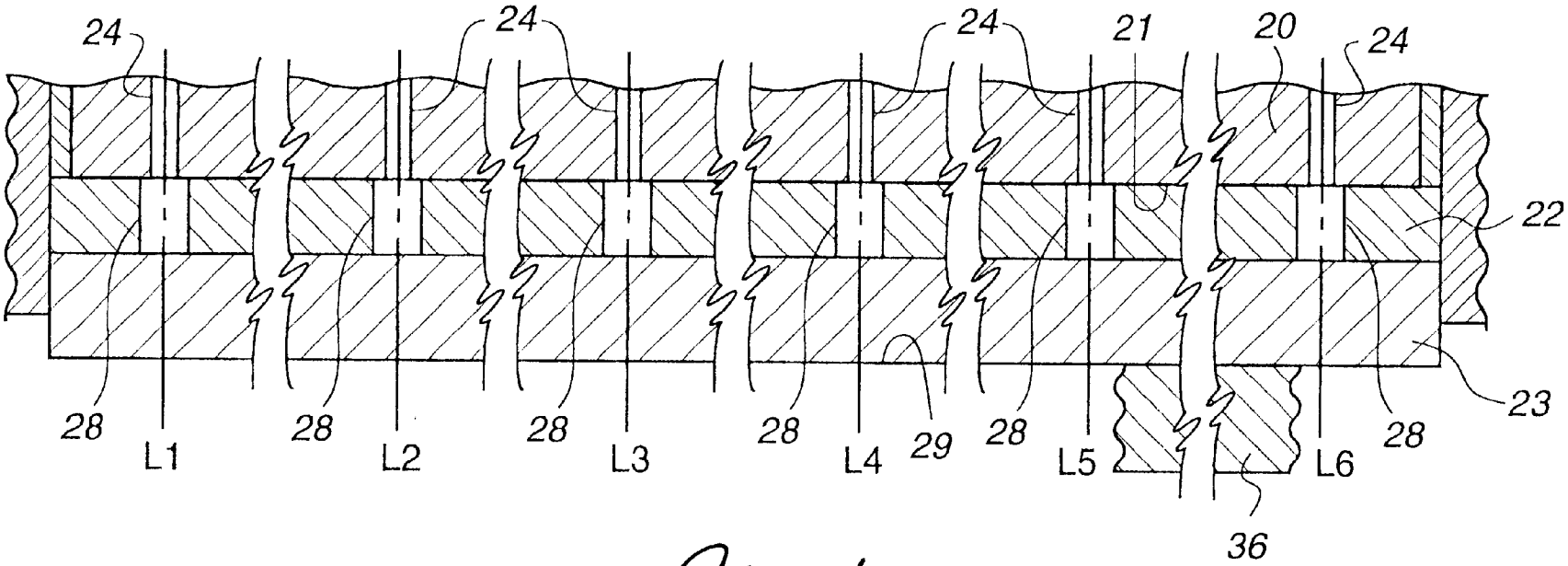
Fig. 1B (Prior Art)
FIG. 1B is a cross sectional view taken along line 1B—1B in FIG. 1A, showing the prior carrier provided with the carrier film overlying the carrier for supporting the wafer.
Figure 1E:
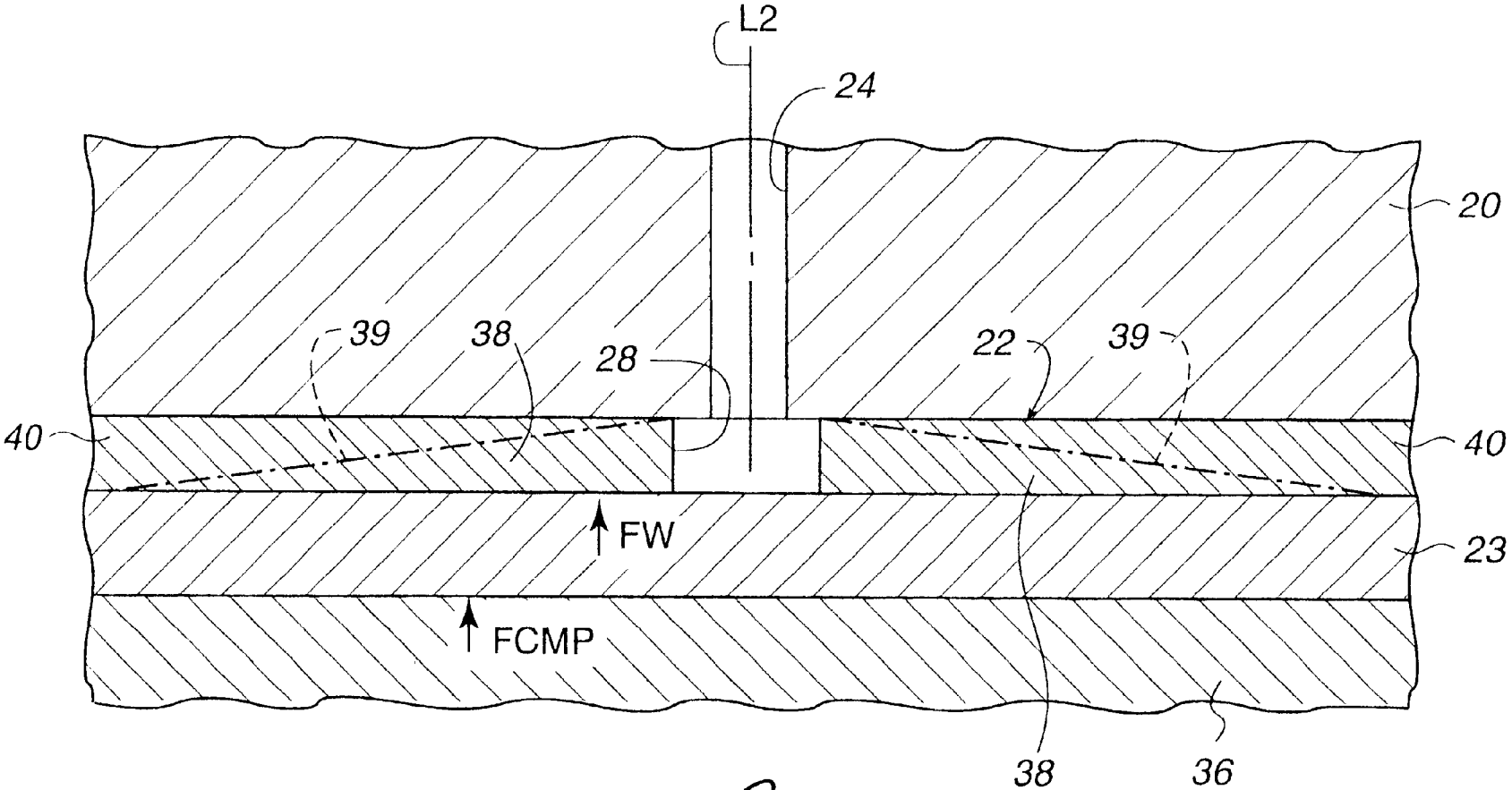
FIG. 1E is an enlarged portion of the carrier shown in FIG. 1B, illustrating results of efforts related to the present invention (indicated as "analysis"), in which characteristics of the carrier film have been identified.
Figure 1Q:
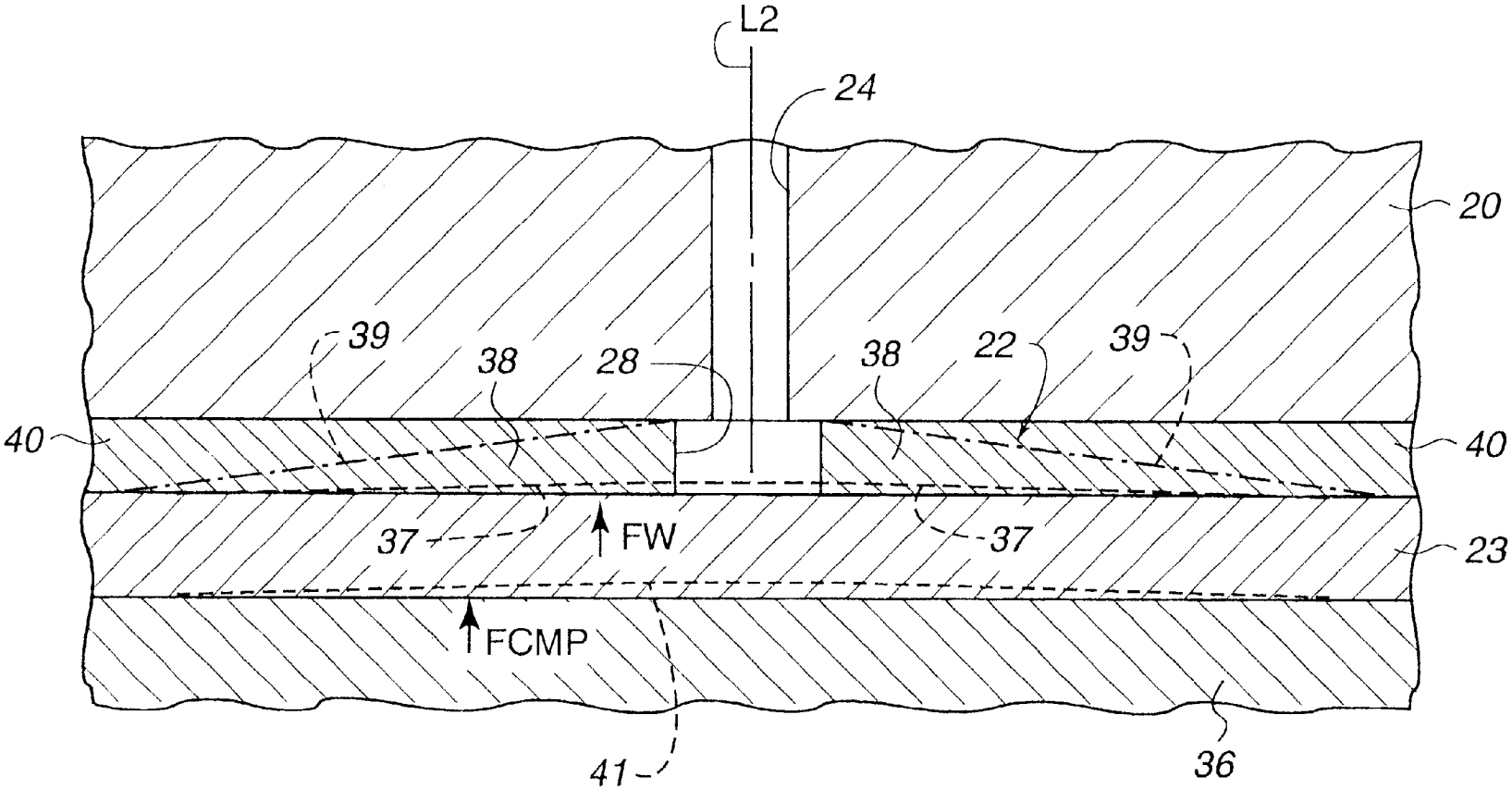
FIG. 1C is a graph showing percent removal rate plotted against locations L1 through L6 at which the carrier holes and carrier film holes are spaced around a hole location circle.
FIG. 1D is a view of an exposed surface of the wafer, wherein concentric circles coaxial with the holes of the carrier and the carrier film illustrate a field effect on the polished exposed surface of the wafer, the field effect defining a portion of the exposed surface which has been subject to reduced removal rate.
FIG. 1F is an enlarged portion of FIG. 1E (and is also indicated as "analysis"), showing one such characteristic of the prior consumable carrier film, which is non-uniform compression of such carrier film during a CMP operation, and illustrating a depressed portion of the wafer resulting from such non-uniform compression of the carrier film.

Such solutions provided by the present invention relate to efforts in the development of the present invention in an endeavor to identify the cause of the low removal rate portions 31 described above. These efforts may be understood by reference to FIGS. 1E and 1F which are identified as "analysis" to indicate depiction of these efforts. FIGS. 1E and 1F show a typical orientation of the prior carrier 20 above the wafer 23, and respectively show one exemplary location (e.g., L2) of the respective holes 24 and 28. These efforts include recognition that the desired CMP operations use a polishing pad 36 to apply a CMP force FCMP to the wafer 23, including such force at all such hole locations (e.g., L1, L2, L3, . . . LN in FIG. 1C) across the exposed surface 29 of the wafer 23. The force FCMP is applied through the wafer 23 to the carrier film 22 and to the carrier 20 as the wafer force FW. These efforts in connection with the present invention indicate that the wafer 23 applies the wafer force FW against such carrier film 22 at all such locations (L1 . . . LN) across the carrier film 22. The wafer force FW is the same at all of the locations L1 . . . LN. The wafer force FW compresses the carrier film 22 as shown in FIG. 1F by an upper dash—dash line 37.

The uncompressed carrier film 22 is shown in FIG. 1E, and has the typical thickness of about 0.020 inches. Such efforts also indicate that the vacuum from one set of the aligned holes 24 and 28 of the carrier 20 (e.g., at location L2) changes the moisture content of the porous carrier film 22. In detail, in FIGS. 1E and 1F, a portion 38 of the carrier film 22 immediately adjacent to one aligned set of holes 24 and 28 is shown having a broad inverted frusto-conical shaped-volume. Such portion 38 is identified by dash-dot-dash lines 39 and has an increasing diameter in the downward direction shown in FIGS. 1E and 1F. Such efforts indicate that as the moisture content in the portion 38 changes, the spring factor of the carrier film 22 also changes. This spring factor change is such that the portion 38 (having the inverted frusto-conically shaped volume immediately around a particular set of aligned holes 24 and 28) tends to compress more in response to the same force FW as compared to the amount of compression of other portions 40 of the carrier film 22. Those other portions 40 are shown further away from the center of the respective aligned holes 24 and 28, beyond the ends of the lines 39. Those other portions 40 are subject to the same force FW.

A result of such efforts are the analyses that as the wafer 23 is urged by the CMP force FCMP against the carrier film 22, the portion 38 of the carrier film 22 compresses, and that the amount of such compression exceeds the amount of compression of the other portions 40 of the carrier film 22 that are further away from the respective holes 24 and 28. Such efforts also indicate that under the action of the wafer force FW, these different amounts of compression result in the carrier film 22 assuming an undesirable curved configuration illustrated by the dash—dash line 37 in FIG. 1F. Such efforts also indicate to Applicants that the greater amount of compression of the undesirable curved configuration (see line 37) of the prior carrier film 22, and the width (shown horizontal in FIG. 1F) of the portion 38, are sufficient to allow the wafer 23 to deform out of the desirable normal flat shape of the wafer 23 (shown in FIG. 1E) and form a depression (shown in FIG. 1F by a dot—dot line 41). The depression 41 is centered on the center (e.g., L2) of the respective holes 24 and 28. The depression 41 corresponds to one of the above-described low polish-rate areas 31 on the wafer 23 that received the reduced removal rate during CMP operations.

Referring to FIG. 1D, analysis as part of such efforts also indicates that with the wide spacings of the sets of the respective holes 24 and 28 of the prior carrier 20 as described above (i.e., in a path around the circle 26), the deformation of the wafer 23 in response to the CMP force FCMP tends to match these undesirable curved configurations 37 of the carrier film 22, resulting in a series of the wafer depressions 41 centered on, and extending radially outward from, each of the respective centers L1, etc., of the sets of respective holes 24 and 28.

Based on initial aspects of such efforts and experience with the wafer depressions 41 centered at each such respective holes 24 and 28, if the carrier 20 were configured with only one pair of aligned respective holes 24 and 28, there would only be one depression 41 formed in the exposed surface 29 of the wafer 23, and the wafer depression situation would be minimized. However, an aspect of the present invention described below is that if the wafer force FW is applied to the carrier film 22 during CMP operations, and if apparatus and methods are provided for achieving such more uniform compression of the carrier film 22 than the non-uniform compression 37 described above, then the exposed surface 29 of the wafer 22 that contacts the polishing pad 36, for example, will remain substantially flat and not have any of the undesirable depressions 41 (or deformed portions). Contrary to such initial aspects that would still result in one depression 41, the present invention provides such apparatus and methods for achieving such more uniform compression, and eliminating all of the depressions 41.

Figure 2A:
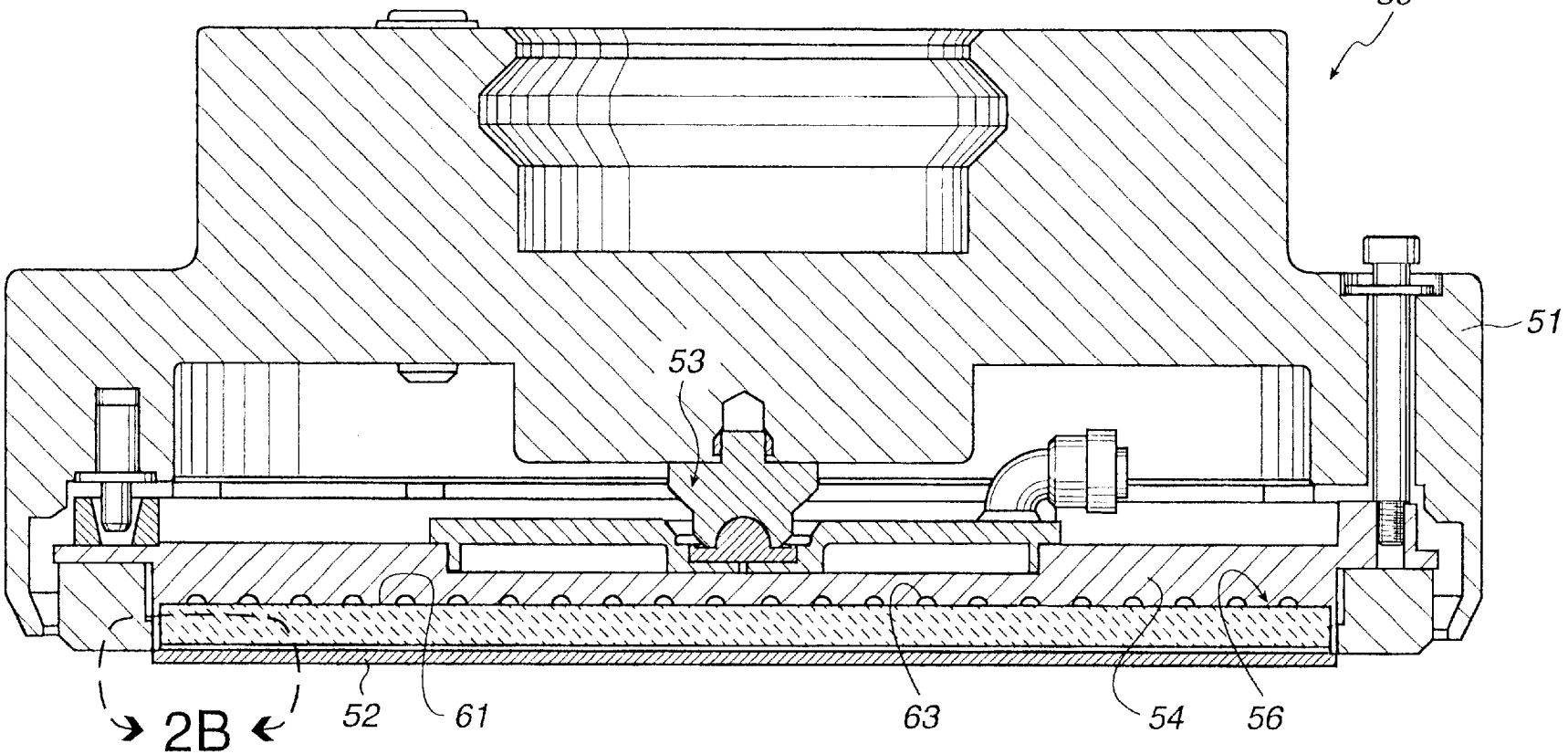

Referring to FIGS. 2A and 2B, the present invention may be understood as providing a CMP apparatus 50 including a carrier housing 51 for mounting a wafer 52 for CMP operations. The carrier housing 51 of the CMP apparatus 50 may, for example, provide a single gimbal 53 for movably mounting a disk-like vacuum plate 54. The plate 54 has a pressure distribution manifold 56 for spreading air pressure (high pressure or a vacuum) across the disk-like plate 54. A flange 57 of the plate 56 assists in retaining a vacuum chuck 58 on the plate 54. The vacuum chuck 58 is protected by a carrier film 59, which in turn contacts the wafer 52 during wafer transfer and CMP operations performed on the wafer 52.

Figure 4A:
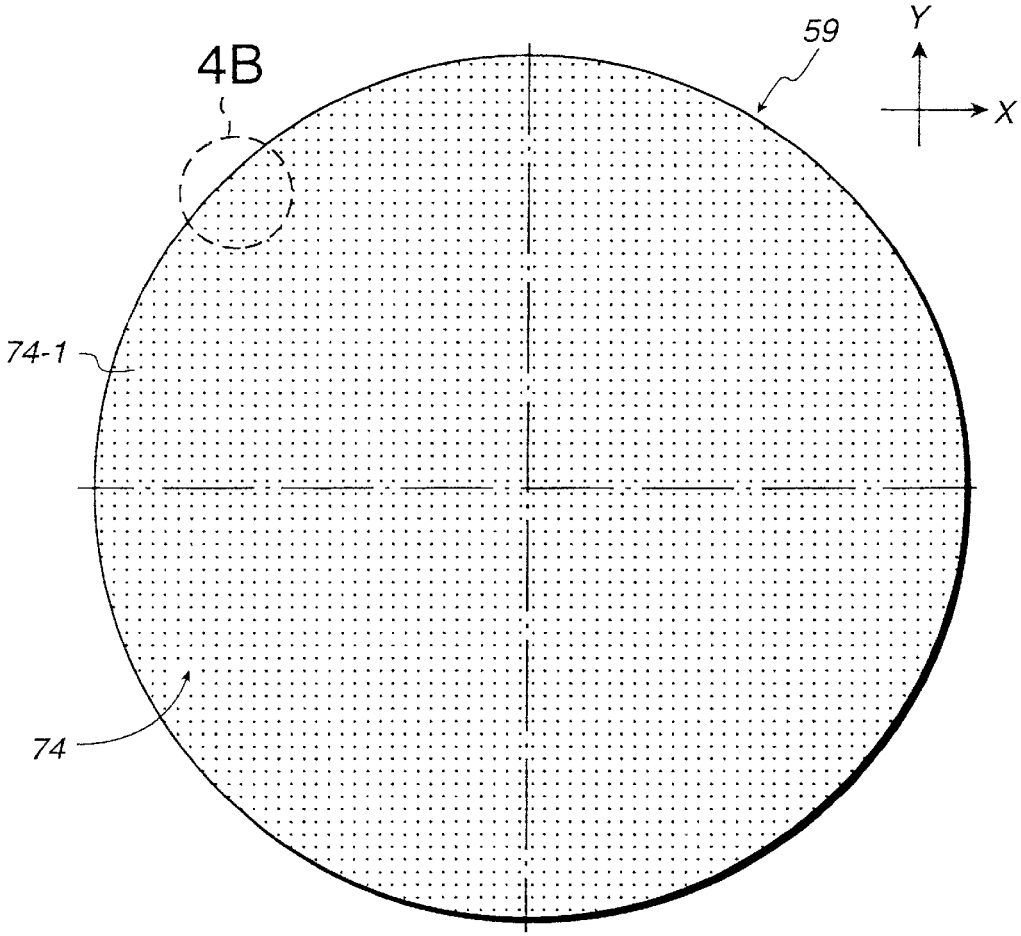
FIG. 4A is a plan view of the carrier film of the present invention showing one embodiment of the array of holes.

FIGS. 3A and 3B show the vacuum chuck 58 having opposite respective first and second surfaces 61 and 62. The first surface 61 defines a flat area by which the chuck 58 contacts manifold ports 63 of the manifold 56 to apply pressure (high or vacuum) to the chuck 58. The second surface 62 defines a carrier film mounting area 64. To secure the carrier film 59 to the chuck 58, adhesive (not shown) may be applied between the surface 62 of the chuck 58 and the carrier film 59. The mounting area 64 has a disk-like configuration corresponding to a disk-like configuration of the carrier film 59 as shown in FIG. 4A.

Dashed section lines in FIGS. 2 and 3 identify the internal structure of the vacuum chuck 58 as being a rigid porous structure extending between the respective first and second surfaces 61 and 62 adjacent to substantially all of the mounting area 64. The rigid porous structure may be fabricated using a sintered ceramic material, such as alumina, having micropores 67, which are micron-sized pores. A preferred embodiment of the micropores 67 has a micropore size of from about 40 microns to about 60 microns.

In FIG. 3B representative micropores 67 are shown enlarged for purposes of illustration. The micropores 67 extend in three orthogonal directions, including X and Z directions in the plane of FIG. 3A, and X and Y directions in the plane of FIG. 4A. The micropores 67 extend between the opposite respective first and second surfaces 61 and 62, and are located adjacent to substantially all of the mounting area 64. In FIG. 3, a detailed portion of the vacuum chuck 58 is shown illustrating a group 68 of the micropores 67 (illustrated by arrows). The group 68 extends from the manifold ports 63, in the direction of the Z axis to the carrier film 59. The group 68 is generally centered on an axis 69 that extends parallel to the Z axis. FIG. 3A shows that the cross section of the group 68 expands from the carrier film 59 toward the vacuum chuck 58. It may be understood that such an axis 69 may be provided at any location along the X axis. In the description below the axis 69 shown in FIG. 3A identifies any desired location along the X axis of such a group 68 at which such a group of the micropores 67 may be located.

FIGS. 3A, 3B, 4A, 4B, and 4C depict one embodiment of the carrier film 59. The film 59 may be 0.020 inches in thickness, for example, and have a diameter of about 7.8 inches, which may correspond to the diameter of the vacuum chuck 58. The carrier film 59 has a third surface 71 configured to engage an underside 72 of the wafer 52. The underside 72 is the wafer side not exposed to the CMP process. The film 59 also has a fourth surface 73 configured to engage the second surface 62 of the vacuum chuck 58. The carrier film 59 may be made from flexible, compressible material such as R200 material made by Rodel. Such material is porous to the flow of liquids such as water. The film 59 has a spring constant that may vary depending, for example, on the amount of water in the material, which amount may be a function of the amount of vacuum applied across the respective first and second surfaces 71 and 73, or a function of the amount of water forced through the carrier film 59.

Figure 4C:
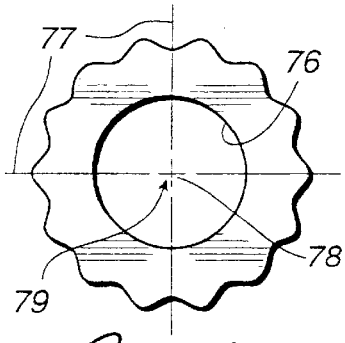
FIG. 4C is a further enlargement of one hole shown in FIG. 4A, illustrating the hole centered on intersecting lines of a grid.
Figure 4B:
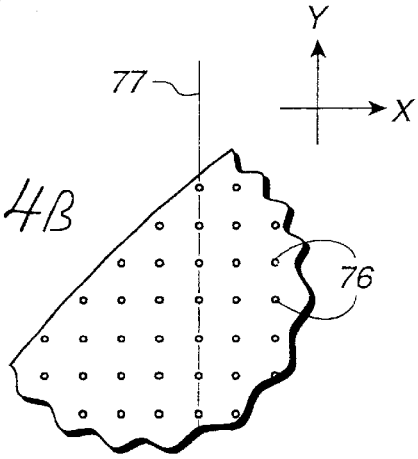
FIG. 4B shows an enlarged portion of FIG. 4A in which the array is a uniform geometric pattern.

As shown in FIGS. 4A, 4B and 4C, the film 59 is provided with an array 74-1 of holes 76. The array 74-1 is an ordered arrangement of the holes 76, that is, an arrangement having a single form or pattern, such as a single pattern in the directions of the X and Y axes (FIG. 4A). To define the single form (or pattern) of the holes 76 in the array 74-1 of the embodiment shown in FIGS. 4A–4C, the pattern may be described as a uniform geometric pattern. As shown in FIG. 4B, such uniform geometric pattern may be defined by a grid of orthogonally arranged lines 77. FIG. 4C shows locations of centers 78 of the holes 76 being defined by intersections 79 of the lines 77. In FIG. 4B a square pattern of the holes 76 is defined by the intersections 79 of the lines 77. Such square pattern may provide each one of the holes 76 spaced from the other of the holes 76 by 0.060 inches in directions parallel to the X and Y axes. The distance from one hole 76 to an adjacent hole 76 on a diagonal to the lines 77 may be 0.085 inches, for example.

Figure 5A:
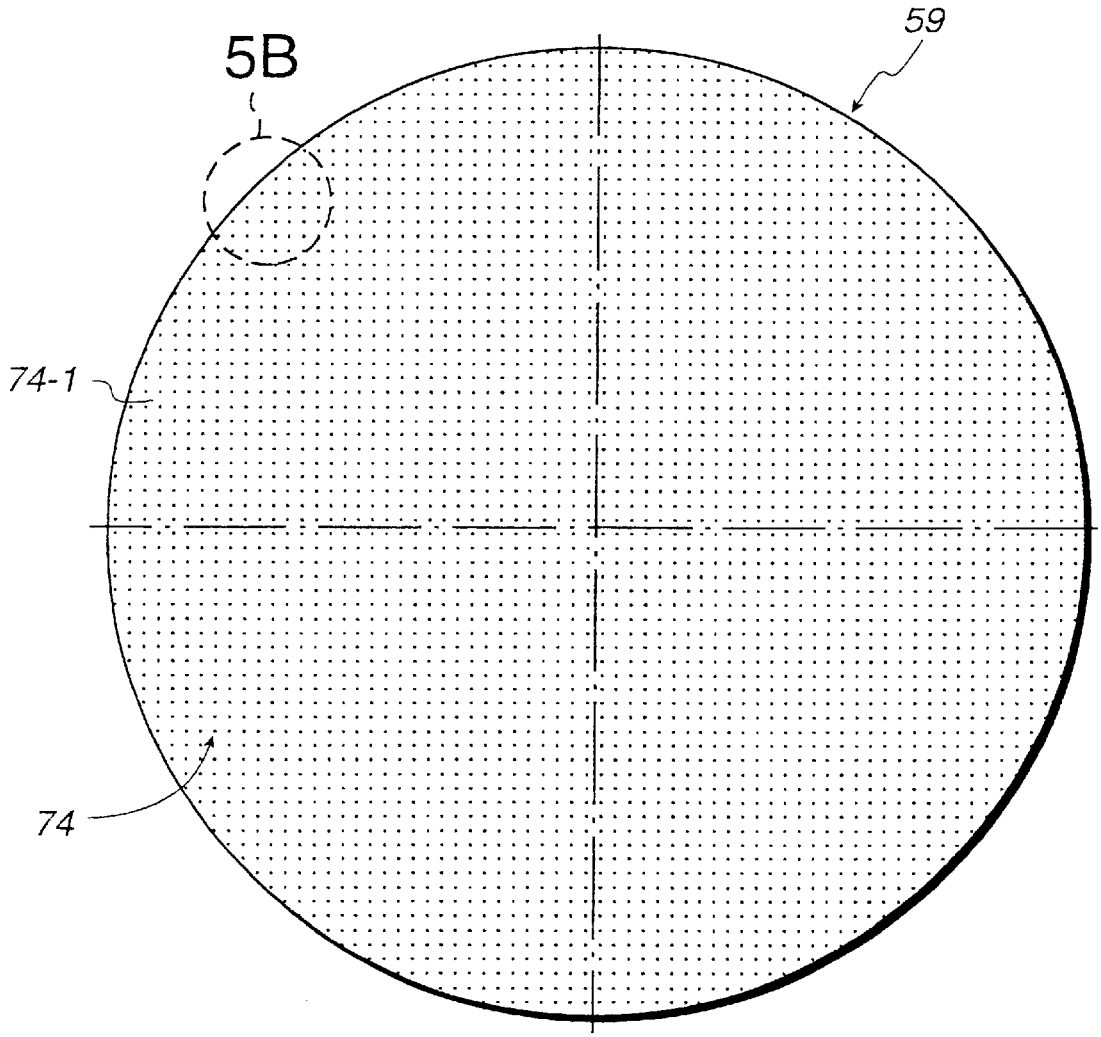
FIG. 5A is a plan view of the carrier film of the present invention showing another embodiment of the array of holes.
Figure 5B:
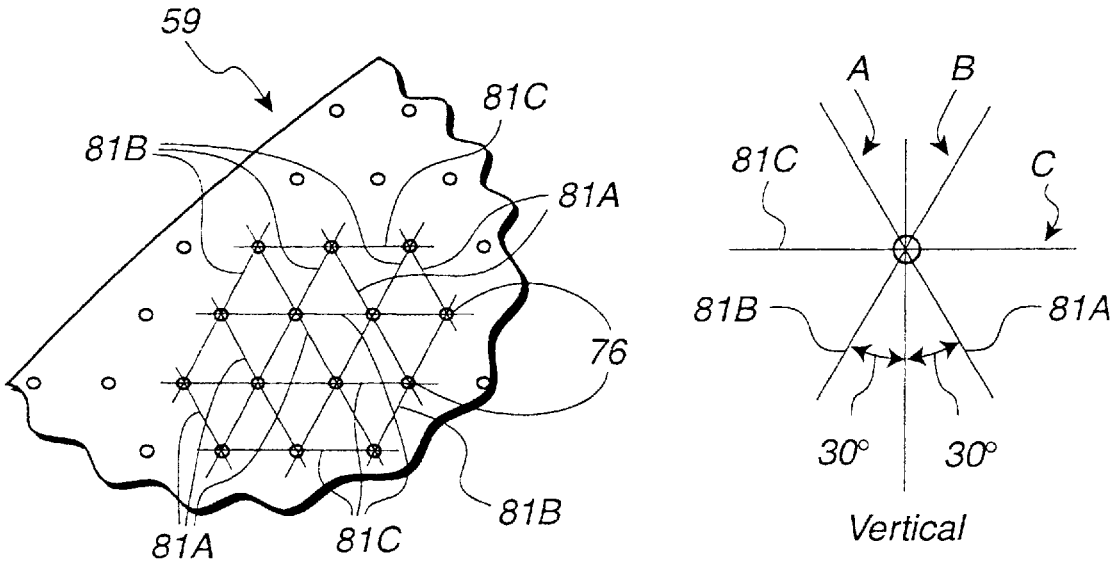
FIG. 5B shows an enlarged portion of FIG. 5A in which the array of holes is also a uniform geometric pattern.
Figure 5C:
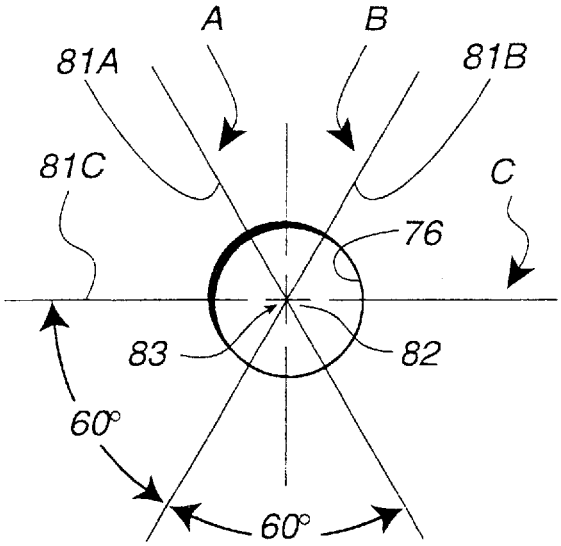
FIG. 5C is a further enlargement of one hole shown in FIG. 5A, illustrating the hole centered on intersecting lines of a grid.

FIGS. 5A, 5B and 5C show another embodiment of the film 59 having an array 74-2 of holes 76 configured with a single form or pattern that is different from the pattern of the array 74-1. The array 74-2 is also an ordered arrangement of the holes 76, that is, an arrangement having a single form or pattern, such as a single pattern in the directions of axes A, B, and C (FIG. 5B). To define the single form of pattern of the holes 76 in the array 74-2 of the embodiment shown in FIGS. 5A–5C, the pattern is also described as uniform geometric pattern, which may be defined by a grid of lines 81 Lines 81A are parallel to the A axis, lines 81B are parallel to the B axis, and lines 81C are parallel to the C axis. For example, the respective lines 81B and 81A may be at an angle of about plus or minus 30 degrees from vertical, and line 81C may be horizontal as viewed in FIG. 5B. In this manner, the lines 81A, 81B and 81C that define one geometric figure are at an angle of about sixty degrees from one another. Locations of centers 82 (FIG. 5C) of the holes 76 are defined by intersections 83 of the respective lines 81A and 81B. The intersections 83 of the lines 81A and 81B define the locations of the holes 76 in the array 74-2 so that the uniform geometric pattern is an equilateral triangular pattern. Such equilateral triangular pattern may provide each one of the holes 76 spaced from each of the two other holes 76 that define such a triangle, wherein the spacing is a preferred distance of about 0.060 inches. Such triangular pattern may provide each one of the holes 76 spaced from such other of the holes 76 by a more preferred distance of about 0.120. Such triangular pattern may provide each such one of the holes 76 spaced from such other of the holes 76 by a most preferred distance of about 0.100 inches.

As compared to the exemplary twenty prior holes 28 spaced from each other by at least one inch, or the prior exemplary six holes spaced by about three and one-half inches, each of the triangular patterns and square patterns described above may be said to define a "close-packed" hole configuration. The term "close-packed" is used since the exemplary 0.060 inch hole spacing (providing about 256 holes per square inch), and 0.120 inch hole spacing (providing about 64 holes per square inch), and 0.250 inch hole spacing (providing about 16 holes per square inch), provides significantly more holes per square inch (i.e., at least 16 times more) than the prior exemplary minimum hole spacing of about one inch.

Referring again to FIG. 3A, two holes 76 of a general type of array are identified by the reference number 74. Such array 74 includes the triangular hole array 742 and the square array 74-1, and any other array that is within the above definition of the term "array". Regardless of the type of array 74, the holes 76 of each such array 74 extend across substantially all of the third surface 73 of the carrier film 59 in contact with the opposing second surface 62 of the vacuum chuck 58. As a result, each of the holes 76 overlaps the rigid porous structure of the ceramic material upon engagement of the third surface 73 of the carrier film 59 with the second surface 62 of the vacuum chuck 58. Also, each of the holes 76 extends from the third surface 73 to the fourth surface 71. Further, as previously described in reference to the enlarged portion of the vacuum chuck 58 shown in FIG. 3A, the group 68 of the micropores 67 extends from the manifold ports 63 in the direction of the Z axis to the third surface 73 of the carrier film 59. As noted above, the group 68 is generally centered on the axis 69, and such axis 69 may be provided (and thus identify) any desired location along the X axis of such group 68 of the micropores 67. Therefore, it may be understood that one such group 68 of micropores 67 may be defined and be aligned with each of the holes 76 of any array 74 of the holes 76. In this manner, wherever a hole 76 is located along the X axis, there will be a group 68 of the micropores 67 aligned with the respective hole 76. Such group 68 of micropores 67 may be described as a primary passageway through which the vacuum or high pressure from the manifold 56 is communicated to the hole 76 of the array 74. The group 68 is the primary passageway because the group 68 is aligned with the hole 76.

In preparation for CMP processing, the uncompressed carrier film 59 is shown in FIG. 3A having the exemplary original thickness of about 0.020 inches. FIG. 3A shows a portion 84R of the carrier film 59 adjacent to one hole 76R and extending toward the next adjacent hole 76L of the array 74. Adjacent to the hole 76R, the portion 84R is similar to the portion 38 in that the portion 84R also has an inverted frusto-conical shaped-volume (i.e., the volume has an increasing diameter in the downward direction shown in FIG. 3A). However, distinct from the portion 38, at a location 85 about midway between adjacent holes 76R and 76L, the portion 84R joins a next adjacent portion 84L that extends (rightward in FIG. 3A) from the next adjacent hole 76L. As the moisture content of the film 59 changes, the spring factor of the carrier film 59 also changes. Contrary to the portion 38, in FIG. 3A there is no portion shown between the portions 84R and 84L having an unchanged spring constant. Rather, the portions 84R and 84L tend to compress generally the same in response to the same force FW as compared to the amount of compression at the midway location 85 between the centers of the respective holes 76R and 76L, wherein the midway locations 85 is subject to the same force FW.

In detail, in response to the CMP force the wafer 52 applies the force FW force against the carrier film 59 and compresses the carrier film 59. However, the carrier film 59 resists such wafer force FW substantially the same at both the portions 84R and 84L adjacent to each respective axis 69 of the primary passageways (represented by the groups 68R and 68L of micropores 67) and respective aligned hole 76 of the carrier film 59, and at the location 85 midway between the axes 69R and 69L of respective adjacent holes 76R and 76L. Thus, the location 85 is an interhole location that is between, and laterally spaced from, such aligned locations of the axes 69R and 69L. The phrase "substantially the same" as used with respect to the carrier film 59 may be understood in terms of the inter-hole distance and the amount of the compression of the prior carrier film 22 described above with respect to the prior undesirable curved configuration 39 adjacent to the hole 24 in the prior carrier 20, and the value of the diameters of the respective prior hole 28, and the hole 76. Such undesirable curved configuration 39 has the wide spacing between pairs of adjacent one of the holes 28 in the prior carrier 20 (e.g., in excess of the exemplary one inch), and the amount of compression that is substantial enough to allow the wafer 23 to be deformed to form the depression 41, and the wide diameter of the hole of the prior carrier film 22 (e.g., about 0.060 inches).

Figure 6:
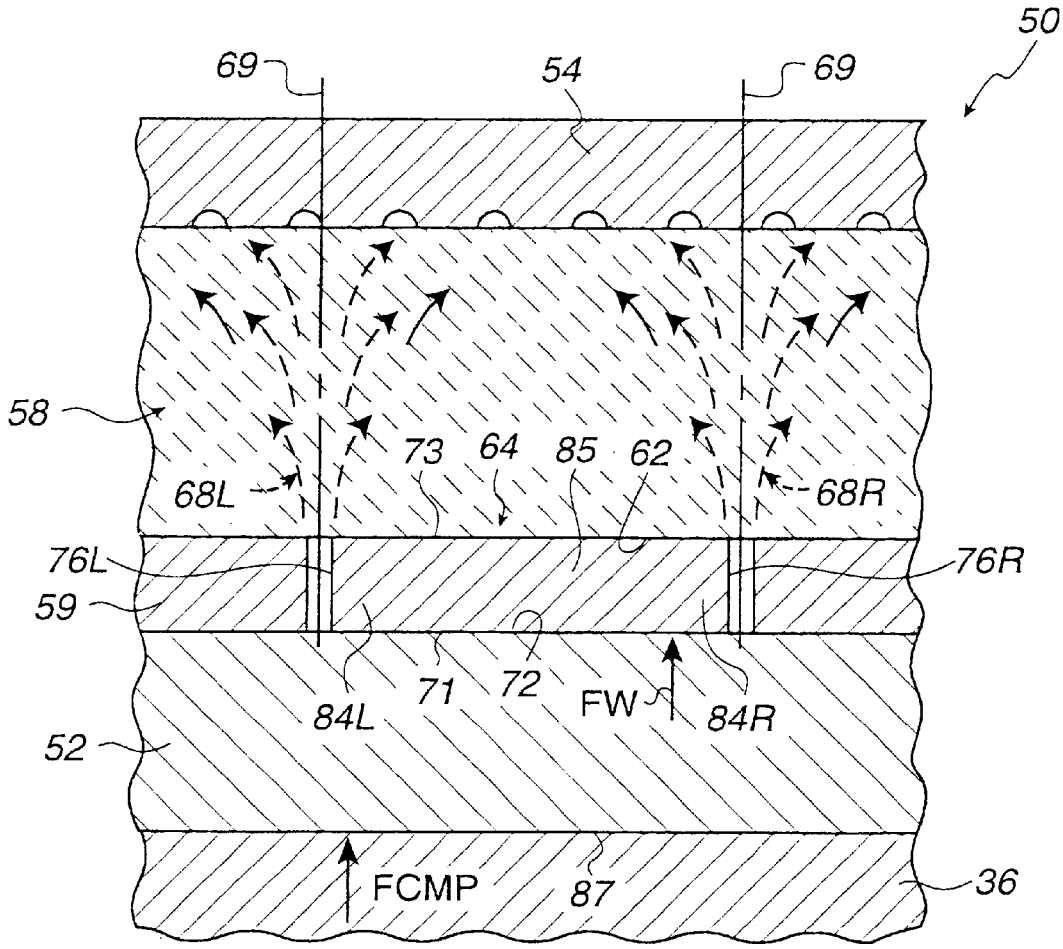
FIG. 6 is a cross sectional view of the carrier of the present invention, illustrating a wafer used in CMP operations with the carrier and carrier film of the present invention, wherein the wafer does not have the low removal rate portions described with respect to FIG. 1D.

In comparison, FIG. 6 shows that in response to the CMP force FCMP the resulting desirable configuration of the third (wafer-engaging) surface 71 of the carrier film 59 of the present invention is significantly less curved than the corresponding surface of the wafer 23 in FIG. 1F. This results from the very small inter-hole spacing between the pair of the adjacent ones of the holes 76R and 76L of the array 74 of holes in the perforated carrier film 59. For example, such interhole spacing is about 0.120 inches in the more preferred embodiment. This desirable configuration also results from the relatively small diameter of the exemplary holes 76R and 76L in the perforated carrier film 59 (e.g., about 0.007 inches). Such exemplary small hole spacing and small hole diameters apparently result in a substantially reduced amount of the compression of carrier film 59 between the holes 76R and 76L, in that there is no low-polished area on the wafer 52. Due to such substantially reduced inter-hole distance between the holes 76R and 76L, the 0.028 inch thickness of the wafer 52 is apparently now large relative to the substantially reduced amount of such compression, and more uniformity of the compression of the film 59. Thus, when the wafer 52 and the carrier film 59 are urged toward each other the wafer 52 is not deformed enough to have an exposed surface 87 of the wafer 52 assume a configuration that would interfere with the desired CMP operations. That is, between the respective holes 76R and 76L in the two-dimensional uniform pattern (array 74) in the carrier film 59, the configuration of the exposed surface 87 of the wafer 52 is devoid of the prior depressions 41.

The present invention includes a method of manufacturing the wafer carrier film 59 and the vacuum chuck 58 to reduce the undesired effects of the carrier film 59 and the chuck 58 on chemical mechanical polishing operations performed on the wafer 52 mounted on the film 59. The method may include an operation of providing the vacuum chuck 58 having the opposite first and second surfaces 61 and 62. The second surface 62 defines the carrier film mounting area 64. The vacuum chuck 58 is provided with the rigid porous structure extending between the respective first and second surfaces 61 and 62 adjacent to substantially all of the first mounting area 64. Another operation of the method may include providing the carrier film 59 having the third surface 71 configured to engage the wafer 52 and the fourth surface 73 configured to engage the surface 62 of the manifold 56 of the vacuum chuck 58. The carrier film 59 is provided with the array 74 of the holes 76 extending across substantially all of the fourth surface 73. Another operation of the method may include engaging the first mounting area 64 with the fourth surface 73 of the carrier film 59 to cause each of the holes 76 to overlap the rigid porous structure 66 of the ceramic material of the chuck 58.

In another aspect of such method, the operation of providing the carrier film 59 provides each hole 76 in the array 74 with the diameter of from about 0.005+ or −0.002 inches to about 0.020+ or −0.002 inches and the array 74 spaces the one hole 76 from many adjacent holes 76 by a distance of about 0.060 to 0.250 inches.

In another aspect of such method, the operation of providing the carrier film 59 provides the array 74 with the holes 76 in the uniform geometric pattern shown in either FIG. 4B or 5B. In FIG. 4B, the uniform geometric pattern is defined by equilateral triangles. In FIG. 5B, the uniform geometric pattern is defined by the grid of orthogonally arranged lines 77, and the locations of the holes 76 are defined by the intersections 78 of the lines 77.

The present invention also includes a method of coordinating configurations of structures of the wafer carrier film 59 and of the vacuum chuck 58 to reduce the effects of those structures on chemical mechanical polishing operations performed on the wafer 52 mounted on the structures. The method may include an operation of providing the carrier film 59 having the surface 71 configured to engage the wafer 52 and the surface 73 configured as an area for pressure/vacuum transfer from the vacuum chuck 58. The film 59 is provided with the uniform two-dimensional arrangement of the holes 76, i.e., with the array 74, extending completely across the area for pressure/vacuum transfer. Each of the holes 76 extends parallel to the third dimension Z between the third surface 71 and the fourth surface 73. The method may include another operation of aligning all of the holes 76 of the uniform two-dimensional arrangement of holes 76 with passages in the form of the groups 68 of the micropores 67, which passages extend through the vacuum chuck 58. The aligning operation may be performed, for example, by providing, in engagement with such area for pressure transfer, the rigid porous structure defined by the sintered ceramic material (such as alumina). In another aspect of such method, the operation of providing the carrier film 59 provides each hole 76 in the array 74 with the diameter of from about 0.005+ or −0.002 inches to about 0.020+ or −0.002 inches; and the array 74 spaces the one hole 76 from many adjacent holes 76 by a distance of about 0.060 to 0.250 inches.

In another aspect of such method, the operation of providing the carrier film 59 provides the array 74 with the holes 76 in the uniform geometric pattern shown in either FIG. 4B or 5B. In FIG. 4B, the uniform geometric pattern is defined by equilateral triangles. In FIG. 5B, the uniform geometric pattern is defined by the grid of orthogonally arranged lines 77, and the locations of the holes 76 are defined by the intersections 78 of the lines 77.

Each of the methods of the present invention described above has the benefits of the structure described above with respect to FIG. 6. Thus, when the wafer 52 and the carrier film 59 are urged toward each other the wafer 52 is not deformed enough to have an exposed surface 87 of the wafer 52 assume a configuration that would interfere with the desired CMP operations. That is, between the respective holes 76R and 76L in the two-dimensional uniform pattern (the array 74) in the carrier film 59, the configuration of the exposed surface 87 of the wafer 52 is devoid of the prior depressions 41.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. Apparatus for mounting a wafer for chemical mechanical polishing operations, the apparatus comprising:

a vacuum chuck having opposite first and second surfaces, the first surface defining a first mounting area, the vacuum chuck having a rigid porous structure extending between the first and second surfaces adjacent to substantially all of the first mounting area; and a carrier film having a third surface configured to engage a wafer and a fourth surface configured to engage the first surface of the vacuum chuck, the film having an array of holes extending across substantially all of the fourth surface to cause each of the holes to overlap the rigid porous structure upon engagement of the fourth surface of the carrier film with the first surface of the vacuum chuck, each of the holes extending from the third surface to the fourth surface, wherein each hole in the array has a diameter of from about 0.005 inches to about 0.020 inches and the holes are spaced from each other by a distance of from about 0.060 to 0.250 inches.

2. Apparatus as recited in claim 1, wherein the rigid porous structure is sintered ceramic material having a pore size of from about 40 microns to about 60 microns.

3. Apparatus as recited in claim 1, wherein the array of holes in the carrier film has a uniform arrangement throughout the extent of the array extending across substantially all of the fourth surface, wherein the uniform arrangement of the array of holes in the carrier film is defined by equilateral triangles, wherein one of the holes is at each apex of each of the equilateral triangles.

4. Apparatus for mounting a wafer for chemical mechanical polishing operations, the apparatus comprising:

a vacuum chuck having opposite first and second surfaces, the first surface defining a first mounting area, the vacuum chuck having a rigid porous structure extending between the first and second surfaces adjacent to substantially all of the first mounting area, the porous structure being defined by sintered ceramic material having micropores therein extending in three orthogonal directions between the opposite first and second surfaces; and a carrier film having a third surface configured to engage a wafer and a fourth surface configured to engage the first surface of the vacuum chuck, the film having a uniform arrangement of holes extending in two of the three orthogonal directions between the third and fourth surfaces adjacent to substantially all of the fourth surface, each of the holes extending parallel to the third dimension between the third and fourth surfaces, the uniform arrangement spacing a first one of the holes at substantially equal distances from adjacent other ones of the holes, each of the holes being overlapped by a plurality of the micropores of the ceramic material when the first surface of the vacuum chuck engages the fourth surface of the carrier film, wherein each hole in the arrangement has a diameter of from about 0.005 inches to about 0.020 inches and the holes are spaced from each other from about 0.060 to about 0.250 inches.

5. Apparatus as recited in claim 4, wherein the uniform arrangement of the array of holes in the carrier film is defined by equilateral triangles, wherein each triangle has opposite apices and one of the holes is at each apex of each of the equilateral triangles.

6. Apparatus for positioning a wafer for chemical mechanical polishing operations, the apparatus comprising:

a housing having a manifold for distributing gas at a range of pressures from a vacuum to positive pressure;

a vacuum chuck mounted on the housing overlying the manifold for receiving the range of pressures, the vacuum chuck having a structure configured with a flat mounting section having a mounting area and comprising micropores extending across substantially all of the mounting area, groups of the micropores providing continuous passageways extending generally perpendicular to the flat mounting section; and a carrier film mounted on the vacuum chuck and having a first surface configured to engage a wafer and a second surface configured to engage substantially all of the mounting area, the film having from about 16 to 256 holes per square inch of the second surface, the holes extending from the first surface to the second surface in a two-dimensional uniform pattern extending across the entire second surface.

7. Apparatus as recited in claim 6, wherein each hole in the array has a diameter of from about 0.005 inches to about 0.020 inches.

8. Apparatus as recited in claim 6, wherein each of the holes is overlapped by at least one group of the micropores when the mounting area of the vacuum chuck engages the second surface of the carrier film.

* * * * *